US011252789B2

(12) United States Patent
Dolinski et al.

(10) Patent No.: US 11,252,789 B2
(45) **Date of Patent: *Feb. 15, 2022**

(54) TEMPERATURE CONTROLLING DEVICE FOR AN APPLIANCE HEATING ELEMENT

(71) Applicant: WHIRLPOOL CORPORATION, Benton Harbor, MI (US)

(72) Inventors: Diego D. Dolinski, Joinville (BR); Timothy A. Mayberry, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 214 days.

This patent is subject to a terminal disclaimer.

(21) Appl. No.: 16/541,458

(22) Filed: Aug. 15, 2019

(65) Prior Publication Data

US 2019/0373678 A1 Dec. 5, 2019

Related U.S. Application Data

(62) Division of application No. 14/881,345, filed on Oct. 13, 2015, now Pat. No. 10,440,778.

(51) Int. Cl.

| | |
|---|---|
| ***H05B 3/68*** | (2006.01) |
| ***H05B 1/02*** | (2006.01) |
| ***H05B 6/06*** | (2006.01) |

(52) U.S. Cl.

CPC ..... *H05B 1/0266* (2013.01); *H05B 6/062* (2013.01); *H05B 2213/07* (2013.01)

(58) Field of Classification Search

CPC ..... H05B 1/0202; H05B 1/0213; H05B 3/68; H05B 3/681; H05B 1/0261; H05B 1/0266; H05B 2213/07; H05B 6/062; H05B 1/02

(Continued)

(56) References Cited

U.S. PATENT DOCUMENTS

| | | | |
|---|---|---|---|
| 1,696,684 | A | 12/1928 | Knopp |
| 2,785,266 | A | 3/1957 | Lewis et al. |

(Continued)

FOREIGN PATENT DOCUMENTS

| | | |
|---|---|---|
| WO | 2004008923 | 1/2004 |
| WO | 2005053362 | 6/2005 |

(Continued)

*Primary Examiner* — Sang Y Paik

(74) *Attorney, Agent, or Firm* — Price Heneveld LLP

(57) ABSTRACT

A burner element for a cooktop includes a heat source for providing heat to a cooking zone positioned above the heat source and an automatic thermostat switch in communication with the cooking zone and the heat source. The automatic thermostat switch senses an actual temperature of the cooking zone, and when the actual temperature reaches a predetermined maximum temperature the automatic thermostat switch moves to an open position defined by the automatic thermostat switch at least partially impeding the heat source. The open position of the automatic thermostat switch is further defined by a decrease in the actual temperature of the cooking zone from approximately the predetermined maximum temperature to a control temperature. When the actual temperature of the cooking zone reaches the control temperature the automatic thermostat switch defines a closed position, wherein the automatic thermostat switch is substantially free of impeding the heat source.

19 Claims, 7 Drawing Sheets

(58) Field of Classification Search
USPC ..... 219/443.1–468.2
See application file for complete search history.

(56) References Cited

U.S. PATENT DOCUMENTS

| | | | | |
|---|---|---|---|---|
| 3,566,075 | A | 2/1971 | Jepson et al. | |
| 3,742,178 | A | 6/1973 | Harnden, Jr. | |
| 4,135,081 | A | 1/1979 | Fischer | |
| 4,414,465 | A | 11/1983 | Newton et al. | |
| 4,554,438 | A | 11/1985 | Schreder | |
| 5,796,346 | A | 8/1998 | Wash et al. | |
| 6,206,564 | B1 | 3/2001 | Adamczewski | |
| 6,246,033 | B1 | 6/2001 | Shah | |
| 6,578,469 | B2 | 6/2003 | Sharpe | |
| 7,473,872 | B2 | 1/2009 | Takimoto | |
| 8,231,269 | B2 | 7/2012 | Bonnel et al. | |
| 8,598,497 | B2 | 12/2013 | Broders et al. | |
| 8,723,085 | B2 | 5/2014 | Callahan et al. | |
| 8,754,351 | B2 | 6/2014 | England et al. | |
| 9,220,130 | B1 | 12/2015 | Smith | |
| 10,440,778 | B2 * | 10/2019 | Dolinski ..... | H05B 6/062 |
| 2004/0016348 | A1 | 1/2004 | Sharpe | |
| 2004/0159650 | A1 | 8/2004 | Steiner et al. | |
| 2012/0132642 | A1 | 5/2012 | Broders et al. | |

FOREIGN PATENT DOCUMENTS

| | | |
|---|---|---|
| WO | 2008003874 | 1/2008 |
| WO | 2012134769 | 10/2012 |

* cited by examiner

TEMPERATURE CONTROLLING DEVICE FOR AN APPLIANCE HEATING ELEMENT

CROSS-REFERENCE TO RELATED APPLICATION

The present application is a divisional of U.S. patent application Ser. No. 14/881,345 filed Oct. 13, 2015, entitled TEMPERATURE CONTROLLING DEVICE FOR AN APPLIANCE HEATING ELEMENT, the entire disclosure of which is hereby incorporated herein by reference.

BACKGROUND

The device is in the field of household cooking appliances, specifically, a temperature controlling device incorporating an automatic thermostat switch for controlling the temperature of the heating element.

SUMMARY

In at least one aspect, a burner element for a cooktop includes a heat source for providing heat to a cooking zone positioned above the heat source and an automatic thermostat switch in communication with the cooking zone and the heat source. The automatic thermostat switch senses an actual temperature of the cooking zone, and when the actual temperature reaches a predetermined maximum temperature, the automatic thermostat switch moves to an open position defined by the automatic thermostat switch at least partially impeding the heat source. The open position of the automatic thermostat switch is further defined by a decrease in the actual temperature of the cooking zone from approximately the predetermined maximum temperature to a control temperature. When the actual temperature of the cooking zone reaches the control temperature, the automatic thermostat switch defines a closed position, wherein the automatic thermostat switch is substantially free of impeding the heat source.

In at least another aspect, a method for controlling a heat source for a burner of a cooktop includes providing a burner element for a cooktop. The burner element includes a heat source for providing heat to a cooking zone positioned above the heat source and an automatic thermostat switch in communication with the cooking zone and the heat source. A heating level is selected for operating the heat source. The actual temperature of the cooking zone is disposed above the heat source. The automatic thermostat switch senses the actual temperature. The actual temperature is compared against a predetermined maximum temperature to determine if the actual temperature has reached the predetermined maximum temperature. A control unit compares the actual and predetermined maximum temperatures. The automatic thermostat switch is moved to the open position when the actual temperature of the cooking zone reaches the predetermined maximum temperature. The actual temperature of the cooking zone is decreased when the automatic thermostat switch is in the open position. The automatic thermostat switch is moved to the closed position when the actual temperature reaches a control temperature, wherein the control temperature is less than the predetermined maximum temperature, wherein the closed position of the automatic thermostat switch is defined by the heat source being free of interference from the automatic thermostat switch.

In at least another aspect, a cooking appliance includes a heating element defining a cooking zone positioned above the heating element. The cooking zone defines an actual temperature. An automatic thermostat switch is in communication with the cooking zone and a control is in communication with the automatic thermostat switch and the heating element. The automatic thermostat switch senses the actual temperature of the cooking zone. When the actual temperature is below a predetermined maximum temperature, the control maintains the automatic thermostat switch in the closed position defined by the heating element being free of impediment by the automatic thermostat switch. When the actual temperature reaches the maximum temperature, the control operates the automatic thermostat switch in an open position defined by the automatic thermostat switch at least partially decreasing an amount of heat provided by the heating element to the cooking zone.

These and other features, advantages, and objects of the present device will be further understood and appreciated by those skilled in the art upon studying the following specification, claims, and appended drawings.

DETAILED DESCRIPTION OF EMBODIMENTS

Figure 1:
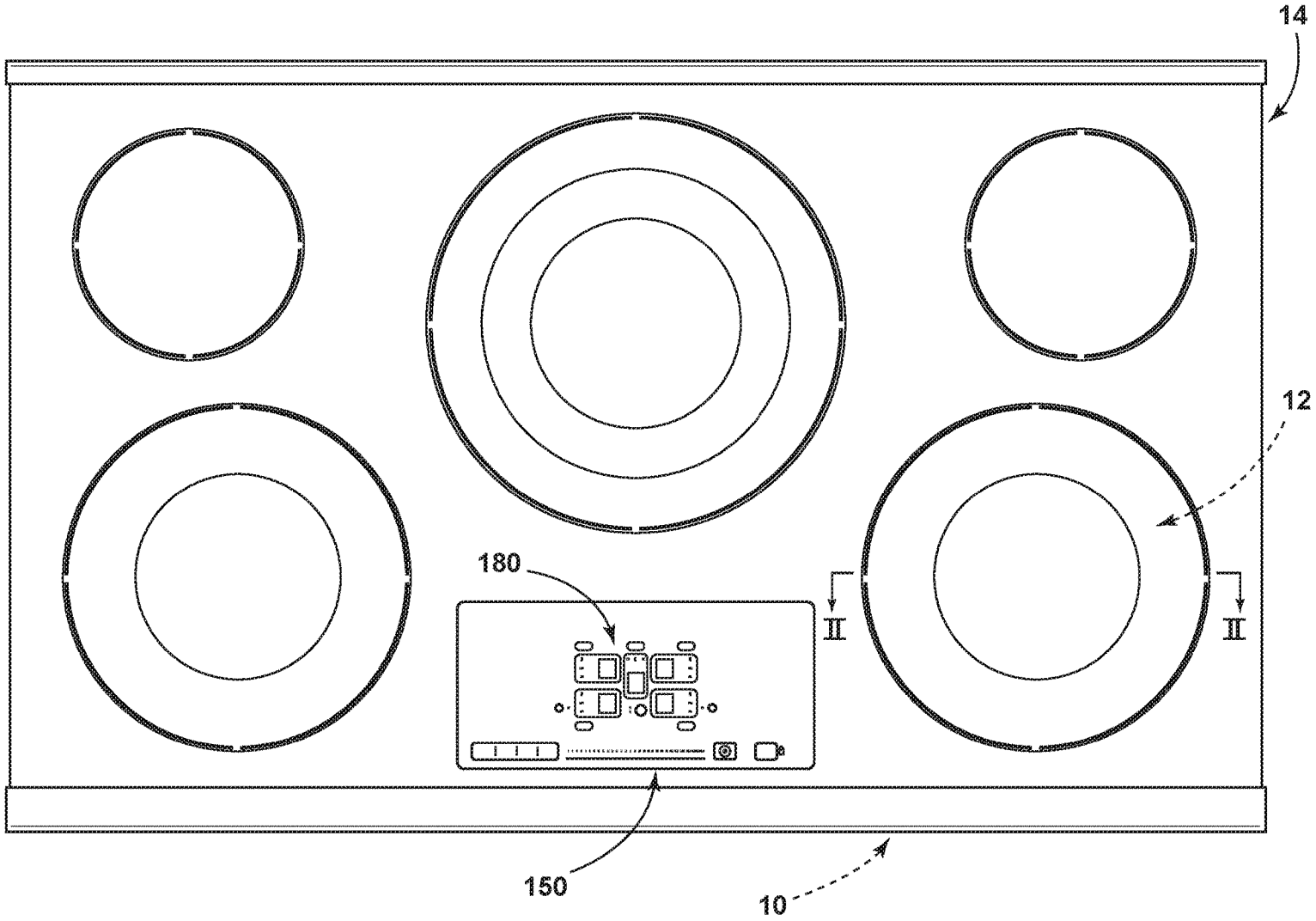
FIG. 1 is a top plan view of a cooktop appliance incorporating an aspect of the automatic temperature controlling device.
Figure 2:
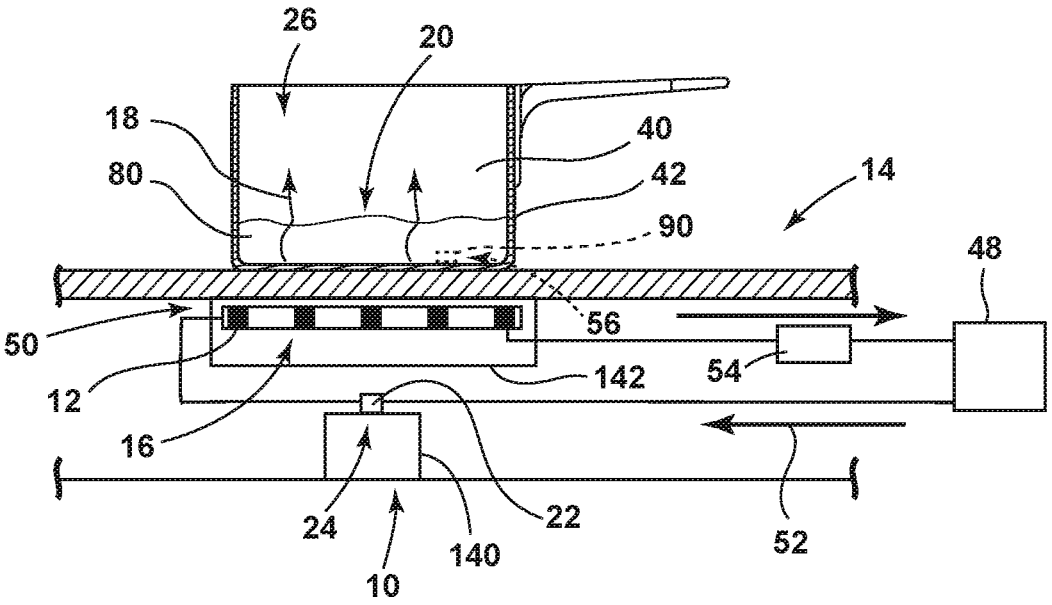
FIG. 2 is a cross-sectional view of the cooktop appliance of FIG. 1, taken along line II-II, shown in operation and having a cooking utensil disposed thereon.
Figure 3:
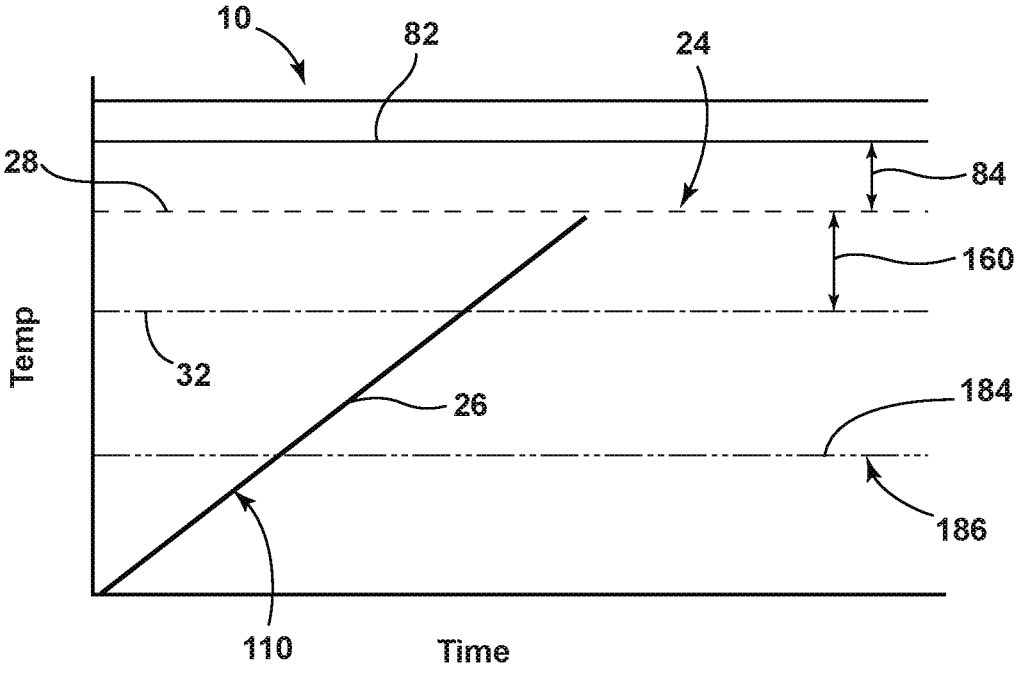
FIG. 3 is a schematic graph illustrating the operation of the cooking appliance of FIG. 2.
Figure 4:
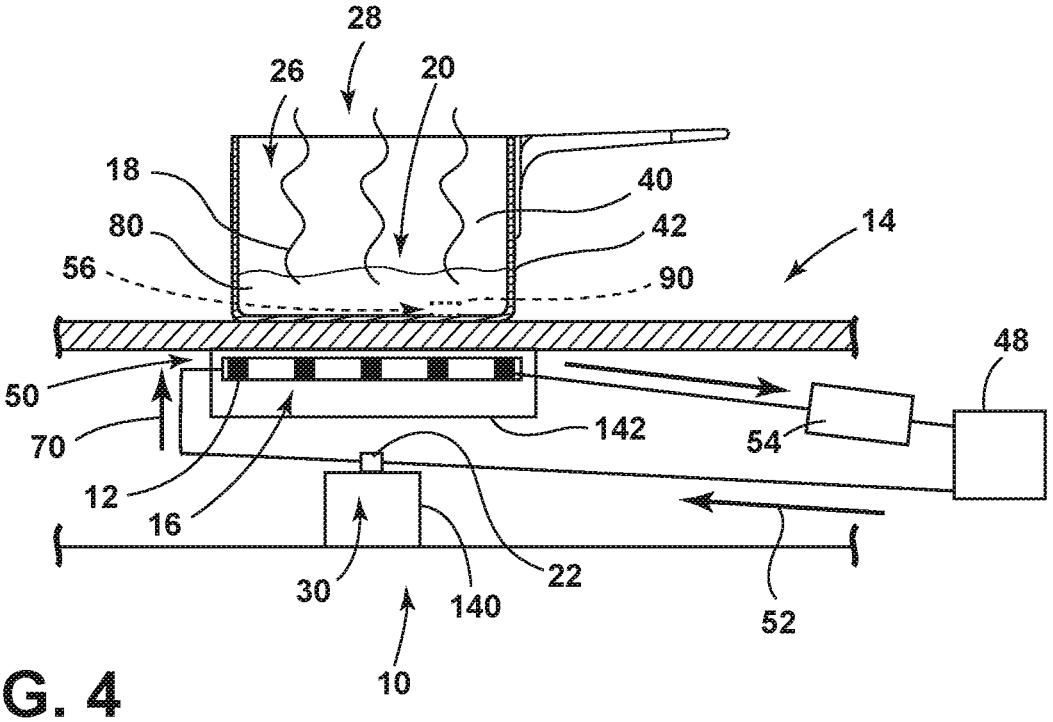
FIG. 4 is a cross-sectional view of the cooking appliance of FIG. 2, showing the temperature of a cooking zone reaching the predetermined maximum temperature.
Figure 5:
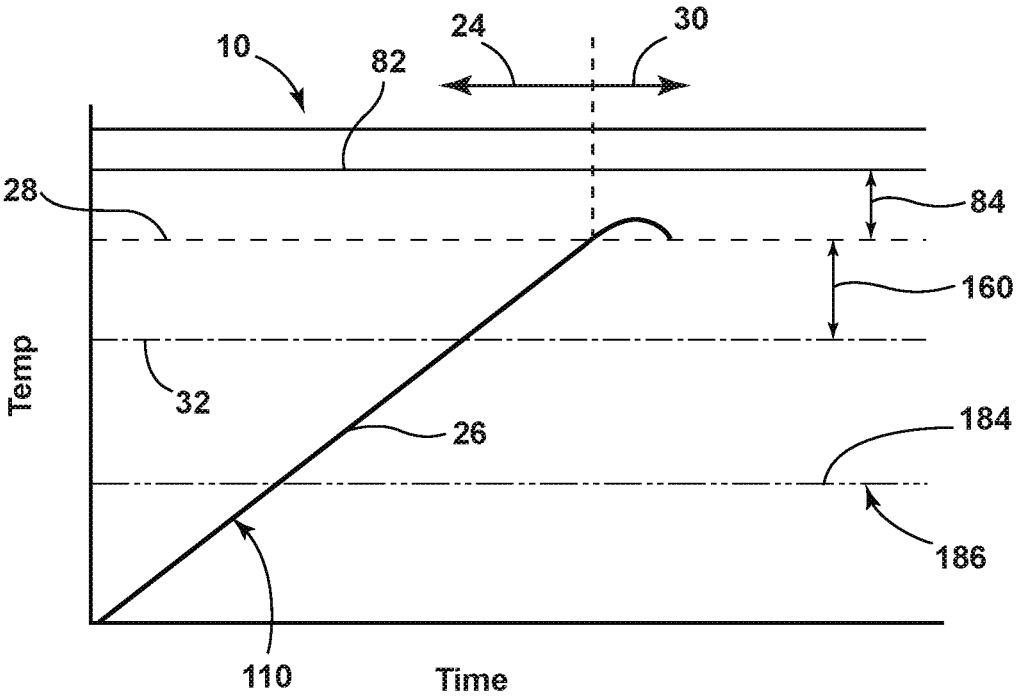
FIG. 5 is a schematic graph illustrating the operation of the cooking appliance of FIG. 4, where the actual temperature has reached the predetermined maximum temperature and the automatic thermostat switch is moved to the open position.
Figure 6:
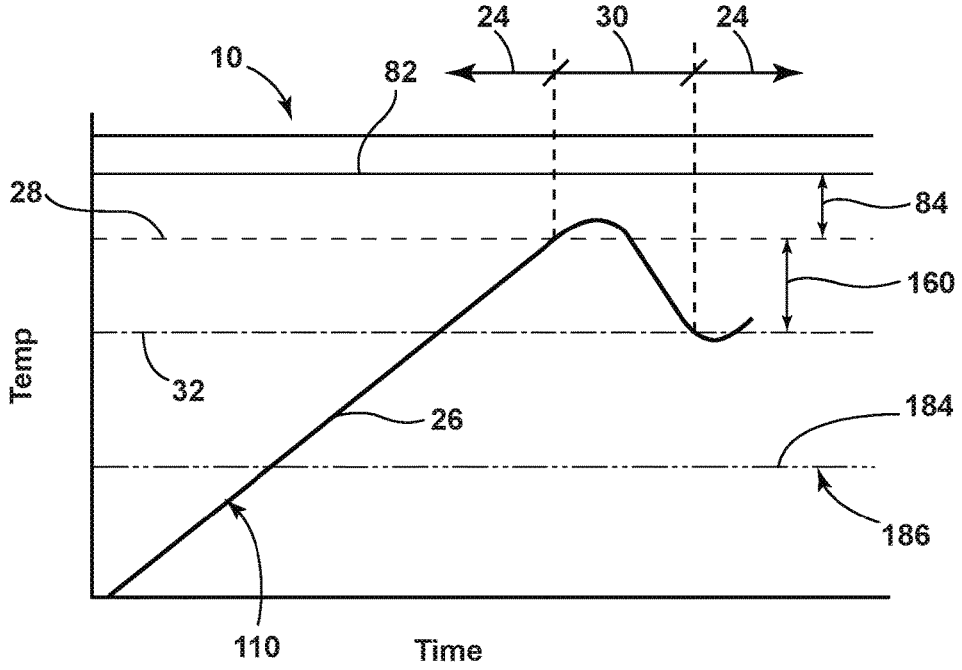
FIG. 6 is a schematic graph illustrating the continued operation of the cooking appliance of FIG. 4 after the actual temperature has reached the control temperature and the automatic thermostat switch has been moved back to the closed position.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-7, reference numeral 10 generally refers to an automatic temperature controlling device incorporated within a burner element 12 of a cooking appliance 14, such as a cooktop, range, countertop heating appliance, toaster, or other similar heating appliance. According to the various embodiments, the burner element 12 for the appliance 14 can include a heat source 16 for providing heat 18 to a cooking zone 20 positioned above the heat source 16. An automatic thermostat switch 22 is in communication with the cooking zone 20 and the heat source 16. The automatic thermostat switch 22, which can typically be in a closed position 24, is configured to sense, or receive measurements of, an actual temperature 26 of the cooking zone 20, such that when the actual temperature 26 of the cooking zone 20 reaches a predetermined maximum temperature 28, the automatic thermostat switch 22 moves to an open position 30. The open position 30 is defined by the automatic thermostat switch 22 at least partially impeding the heat source 16. The open position 30 of the automatic thermostat switch 22 is further defined by a decrease in the actual temperature 26 of the cooking zone 20 from approximately the predetermined maximum temperature 28 to approximately a control temperature 32. When the cooking zone 20 reaches the control temperature 32, the automatic thermostat switch 22 is moved to a closed position 24, where the automatic thermostat switch 22 is substantially free of impediment to the heat source 16. It is contemplated that the cooking zone 20 can be defined by an interior volume 40 of a cooking utensil 42 placed upon the heat source 16. Such a cooking utensil 42 can take the form of a pan, pot, cooking sheet, skillet, cooking grate, rack, or other similar utensil 42 that can be used in conjunction with the burner element 12.

Referring again to FIGS. 1-7, it is contemplated that the heat source 16 for the burner element 12 can be an electric burner 50. In such an embodiment, the open position 30 of the automatic thermostat switch 22 is configured to decrease the flow of electric current from an electrical power source 48 to the electric burner 50 in the direction indicated by arrow 52. It is contemplated that a control unit 54 can be placed in communication with the electric burner 50 and the automatic thermostat switch 22. It is also contemplated that the control unit 54 can receive information regarding the actual temperature 26 of the cooking zone 20 from a temperature sensing component 56 of the automatic thermostat switch 22. Based upon the actual temperature 26, the control unit 54 can compare the actual temperature 26 to the predetermined maximum temperature 28 and the control temperature 32. Based upon this comparison, the control unit 54 can operate the automatic thermostat switch 22 between the open and closed positions 30, 24 to achieve the proper result for operating the automatic temperature controlling device 10 as will be described more fully below.

According to the various embodiments, the decrease in flow of electric current indicated by arrow 52 caused by the automatic thermostat switch 22 being moved to the open position 30 can result in a lesser electric current indicated by arrow 70 being provided to the electric burner 50. It is also contemplated that the open position 30 of the automatic thermostat switch 22 can define a total stoppage of electric current from the electrical power source 48 to the electric burner 50, such that the electric burner 50 is effectively turned off, at least temporarily.

Referring to FIGS. 2-7, the automatic temperature controlling device 10 is configured to prevent various food items 80 placed within the cooking zone 20 from achieving their spontaneous ignition temperatures 82 that may result in the starting of a fire within or proximate the cooking zone 20. During operation of the burner element 12, the temperature sensing component 56 of the automatic thermostat switch 22 senses the actual temperature 26 of the cooking zone 20. This actual temperature 26 is communicated to the control unit 54. Where the actual temperature 26 of the cooking zone 20 is below the predetermined maximum temperature 28, the control unit 54 can maintain the automatic thermostat switch 22 in the closed position 24. It is contemplated that the predetermined maximum temperature 28 can correspond to the spontaneous ignition temperature 82 of a particular food product that is within the cooking zone 20. It is also contemplated that the predetermined maximum temperature 28 can be a buffer temperature 84 that corresponds to and is below a spontaneous ignition temperature 82 of the respective food product within the cooking zone 20. Such a buffer temperature 84 can be a predetermined temperature below the spontaneous ignition temperature 82 or can be a certain temperature percentage below the spontaneous ignition temperature 82 of the respective food product. It is further contemplated that the respective food product within the cooking zone 20 can be any one of a number of food products, where such food products can include, but are not limited to, oil, grease, lard, suet, animal fat, meat, produce, combinations thereof, and other various food items 80 that may be combustible at a particular respective spontaneous ignition temperature 82.

Referring again to FIGS. 2 and 4, it is contemplated that the automatic thermostat switch 22 and the electric burner 50 can be electrically connected in the series circuit configuration. It is also contemplated that parallel configurations can be implemented between the automatic thermostat switch 22 and the burner element 12. In situations where a series circuit is implemented, the automatic thermostat switch 22 can be an automatic reset thermostat switch. The reset thermostat switch 22 can be configured, based upon the actual temperature 26 recorded by the temperature sensing component 56 of the automatic thermostat switch 22, to operate the burner element 12 with a series of on and off cycles so as to vary the heating power provided by the electric burner 50. The on and off cycles can correspond to the open and closed positions 30, 24. It is also contemplated that the open position 30 of the automatic thermostat switch 22 can define a pattern of on and off cycles of the burner element 12 that results in a decrease of the actual temperature 26 to the control temperature 32.

According to the various embodiments, the temperature sensing component 56 of the automatic thermostat switch 22 can include a thermocouple 90 that is disposed proximate the cooking zone 20. In such an embodiment, the automatic thermostat switch 22 can be placed in communication with the thermocouple 90, such that the thermocouple 90 can measure the actual temperature 26 of the cooking zone 20. The temperature sensing component 56 of the automatic thermostat switch 22 can also take the form of other temperature sensing mechanisms that can include, but are not limited to, thermistors, thermostats, thermometers, heat imaging sensors, temperature sensing cameras, thermal imaging devices, combinations thereof, and other similar temperature sensing mechanisms.

Referring again to FIGS. 2 and 4, it is contemplated that the automatic thermostat switch 22 and the temperature sensing component 56 of the automatic thermostat switch 22 can be positioned below the heat source 16 to record the actual temperature 26. In this manner, the actual temperature 26 is recorded as an indirect measurement of heat 18 emanating from a cooking utensil 42.

According to the various embodiments, where a thermocouple 90 is used as the temperature sensing component 56 of the automatic thermostat switch 22, the thermocouple 90 can be disposed proximate a surface of the cooktop, such that the thermocouple 90 can be placed in communication with the cooking utensil 42. It is also contemplated that the thermocouple 90 can be incorporated within the cooking utensil 42 and signal communication between the thermocouple 90 and the automatic thermostat switch 22 can be achieved through an induction-type interface, wireless communication or other similar signal communication. It is also contemplated that the thermocouple 90 can be disposed within, or on interior surface of, the cooking utensil 42 for measuring the temperature of the cooking zone 20.

Referring again to FIGS. 1-7, a cooking appliance 14 incorporating the automatic temperature controlling device 10 can include a heating element or burner element 12 defining the cooking zone 20 that is positioned above the burner element 12, where the cooking zone 20 defines an actual temperature 26 that can be sensed by the automatic thermostat switch 22. The automatic thermostat switch 22 can be in communication with the cooking zone 20. A control unit 54 is configured to be in communication with the automatic thermostat switch 22 and the burner element 12, where the automatic thermostat switch 22 senses the actual temperature 26 of the cooking zone 20. When the actual temperature 26 sensed by the automatic thermostat switch 22 is below the predetermined maximum temperature 28, substantially corresponding to a spontaneous ignition temperature 82 of a particular food item 80, the control unit 54 maintains the automatic thermostat switch 22 in a closed position 24 defined by the heating element being free of impediment by the automatic thermostat switch 22. When the actual temperature 26 sensed by the automatic thermostat switch 22 reaches the predetermined maximum temperature 28, the control unit 54 operates the automatic thermostat switch 22 to the open position 30 such that the automatic thermostat switch 22 at least partially decreases or limits an amount of heat 18 provided by the burner element 12 to the cooking zone 20. The impeding open position 30 of the automatic thermostat switch 22 can be maintained until the actual temperature 26 sensed by the automatic thermostat switch 22 decreases to at least approximately a control temperature 32 of the cooking zone 20. The control temperature 32 can be a buffer temperature 84 of a certain number of degrees or a certain percentage below the predetermined maximum temperature 28. When the actual temperature 26 that is sensed by the automatic thermostat switch 22 reaches the control temperature 32, the control unit 54 operates the automatic thermostat switch 22 to the closed position 24 such that the impediment of the automatic thermostat switch 22 in the open position 30 is removed and the burner element 12 operates in a substantially unimpeded manner.

According to the various embodiments as exemplified in FIGS. 1-8, the burner element 12 of the cooking appliance 14 can include any one of a number of burner elements 12 that can include, but are not limited to, a resistive electric burner 50, a radiant heating element, an induction element, a gas burner 100, combinations thereof, and other similar burner elements 12.

Figure 8:
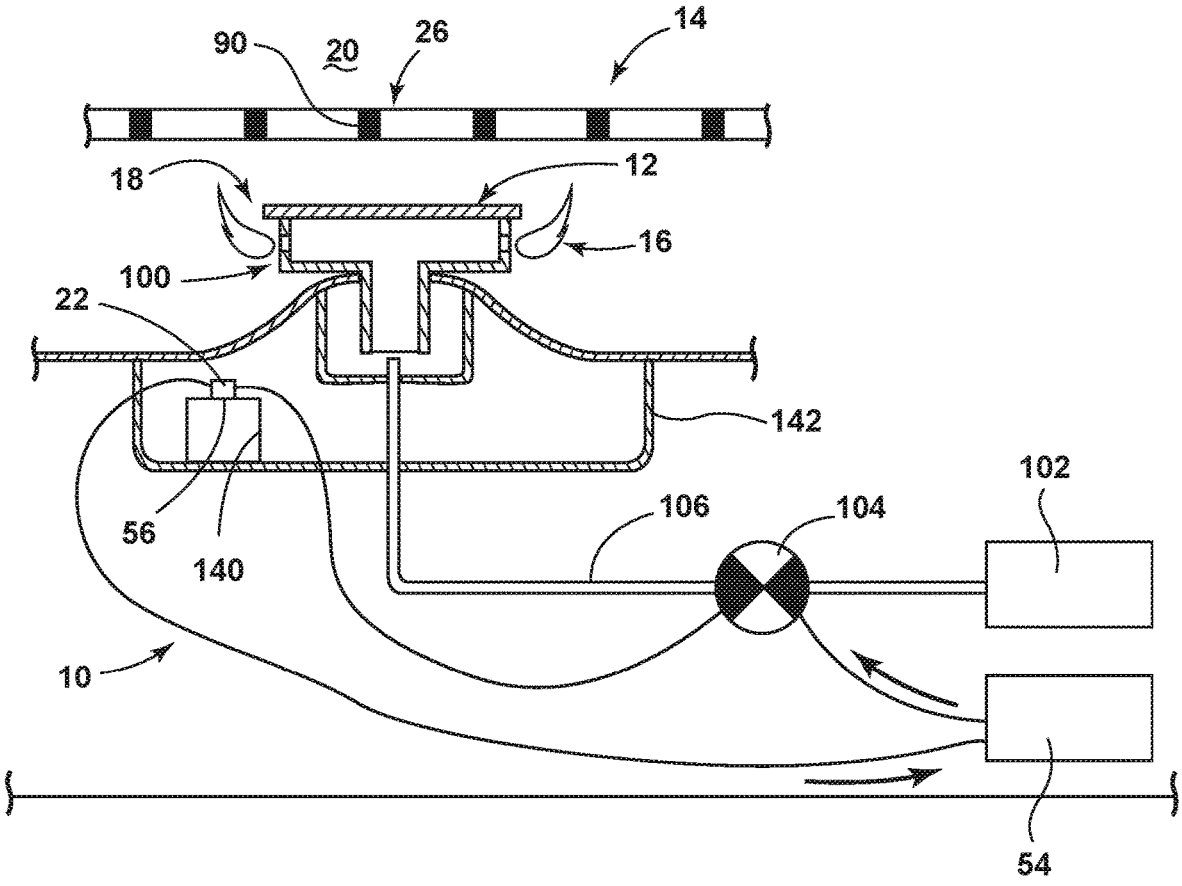
FIG. 8 is a cross-sectional view of another aspect of the cooking appliance illustrating a gas burner for the cooktop appliance.
Figure 9:
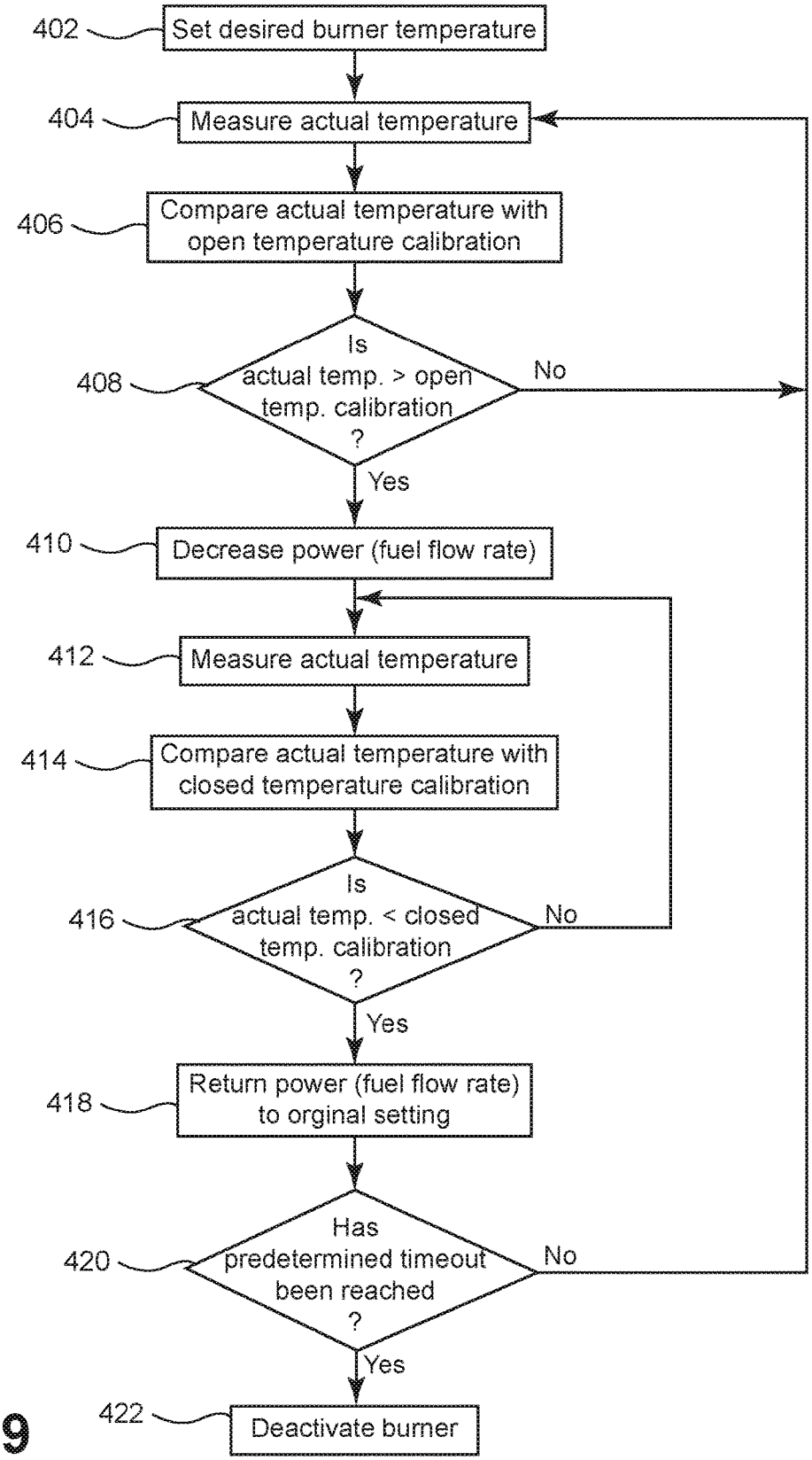
FIG. 9 is a schematic flow chart illustrating operation of an aspect of the automatic temperature controlling device of FIG. 1.

Referring to the aspect of the device as exemplified in FIG. 8, where the burner element 12 is a gas burner 100, the operation of the automatic thermostat switch 22 between the open and closed positions 30, 24 modifies the amount of gaseous fuel 102 provided to the burner element 12. Accordingly, when the temperature sensing component 56 of the automatic thermostat switch 22 senses a temperature of the cooking zone 20 that approaches predetermined maximum temperature 28, the control unit 54 operates the automatic thermostat switch 22 to the open position 30 which operates a valve 104 in communication with a gaseous fuel line 106. The valve 104 is moved to at least partially limit the flow of gaseous fuel 102 to the gas burner 100 such that the amount of heat 18 provided by the gas burner 100 is decreased. As the valve 104 in communication with the gaseous fuel line 106 is operated, the open position 30 of the automatic thermostat switch 22 can operate the valve 104 to a fully closed state to completely stop the flow of gaseous fuel 102 to the gas burner 100, or, the automatic thermostat switch 22 can operate the valve 104 to partially obstruct the gaseous fuel line 106 to decrease the amount of gaseous fuel 102 provided to the gas burner 100.

According to the various embodiments, the degree of limitation provided by the automatic thermostat switch 22 in the open position 30 can be based upon various factors. By way of example, and not limitation, where the actual temperature 26 increases at a high rate toward the predetermined maximum temperature 28, the automatic thermostat switch 22 and/or the control unit 54, can calculate the degree of temperature increase as being a high rate of increase 110. Where a high rate of increase 110 of the actual temperature 26 is present, the open position 30 of the automatic thermostat switch 22 can define a greater limitation of the heat 18 provided by the burner element 12. Accordingly, the flow of electricity, or gaseous fuel 102, depending upon the type of burner, can be totally shut off or substantially shut off such that the rate of increase 110 of the actual temperature 26 can be slowed in an expeditious manner to prevent the actual temperature 26 of the cooking zone 20 from reaching the spontaneous ignition temperature 82 of a particular food item 80 being cooked therein. Such a configuration can serve to gradually slow the rate of increase 110 of the actual temperature 26 toward the predetermined maximum temperature 28. In this manner, when the actual temperature 26 reaches the predetermined maximum temperature 28, the movement of the automatic thermostat switch 22 moving to the open position 30 will begin the decrease of the actual temperature 26 more quickly, since the rate of increase 110 of the actual temperature 26 has already been slowed.

Referring to FIGS. 4-10, it is also contemplated that as the actual temperature 26 reaches the predetermined maximum temperature 28, the automatic thermostat switch 22 can be gradually moved through a series of open positions 30 of a plurality of open positions 30 to modify the limitation of electrical current or gaseous fuel 102 provided to the burner element 12. In this manner, an increase in the temperature toward the predetermined maximum temperature 28 can be decreased by operation of the automatic thermostat switch 22, through an initial large limitation of the amount of electrical current or gaseous fuel 102 provided to the burner element 12. As the rate of increase 110 of the actual temperature 26 becomes less, the amount of limitation provided by the particular open position 30 of the automatic thermostat switch 22 can also be lessened such that increasing amounts of electric current indicated by arrow 52 or gaseous fuel 102 can be provided to the burner element 12. Accordingly, the rate of increase 110 of the actual temperature 26 can be controlled, gradually lessened and eventually decreased to the control temperature 32. It is also contemplated that the various open positions 30 of the plurality of open positions 120 of the automatic thermostat switch 22 can be implemented as the actual temperature 26 decreases from approximately the predetermined maximum temperature 28 to the control temperature 32. In this manner, this change can be a gradual decline from the predetermined maximum temperature 28 to the control temperature 32.

Figure 7:
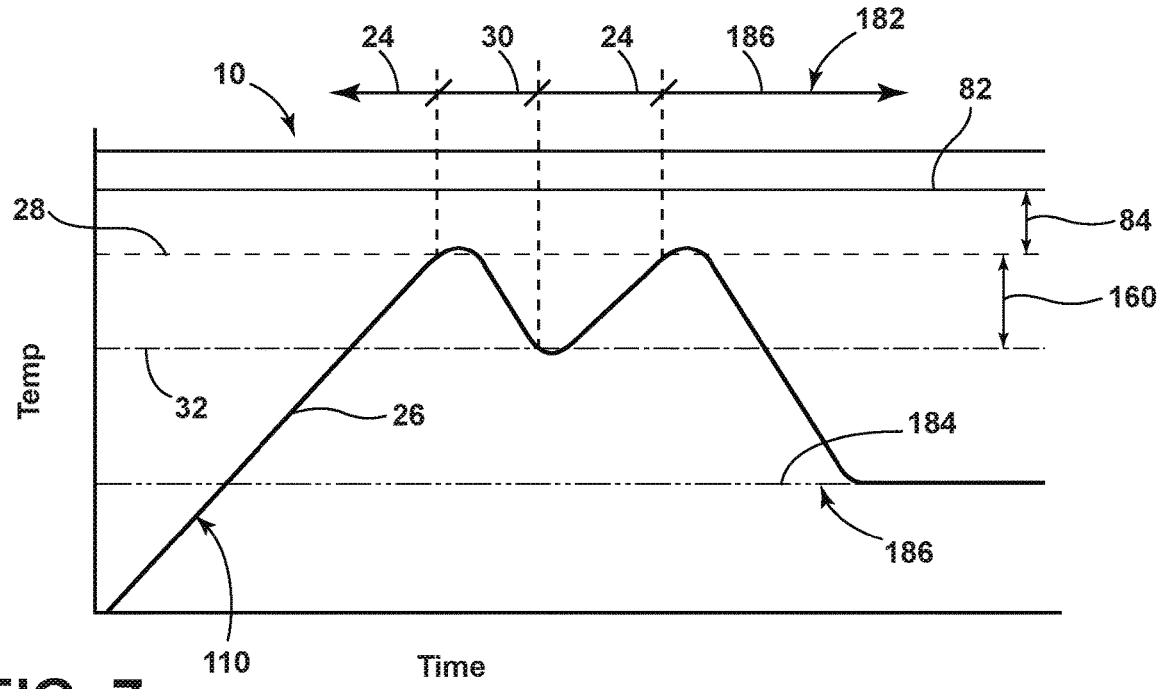
FIG. 7 is a schematic graphical illustration of continued operation of the cooking appliance of FIG. 4 illustrating the effect of the automatic thermostat switch being moved between the open and closed positions as the temperature fluctuates between the predetermined maximum temperature and the control temperature.
Figure 10:
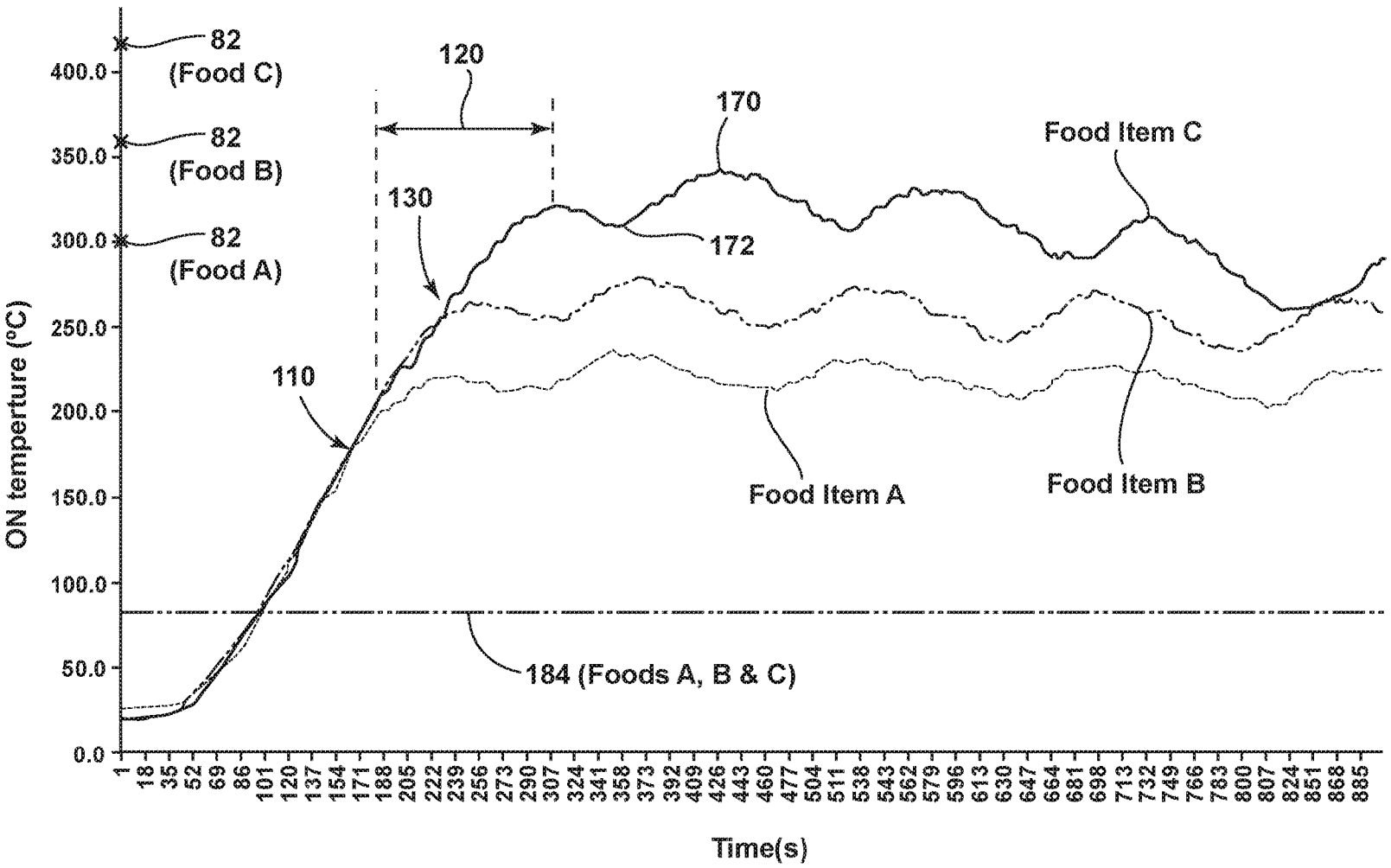
FIG. 10 is a schematic graph illustrating operation of the automatic temperature controlling device illustrating operation of an aspect of the device, when used in conjunction with different food items having different spontaneous ignition temperatures.

According to the various embodiments, as exemplified in FIGS. 7 and 10, the use of the plurality of open positions 120 of the automatic thermostat switch 22 can also be used to extend the wavelength of the temperature curve, as the actual temperature 26 fluctuates between the control temperature 32 and the predetermined maximum temperature 28. In this manner, the open position 30 of the automatic thermostat switch 22 can be defined by a plurality of switch settings 130 that corresponds to the plurality of open positions 120 of the automatic thermostat switch 22. Each of the plurality of switch settings 130 corresponds to a predetermined electrical resistance, in the case of an electric burner 50, or a predetermined valve position, in the case of a gas burner 100. In this manner, each of the plurality of switch settings 130 corresponds to an amount of electric current 52 (or gaseous fuel 102) being delivered to the burner element 12. Accordingly, the plurality of switch settings 130 can be used to increase or decrease the amount of heat 18 being provided by the burner element 12, and also increase or decrease the rate of change of heat 18 provided by the burner element 12.

According to the various embodiments, it is contemplated that the control unit 54 for the automatic thermostat switch 22 can be incorporated in a portion of the automatic thermostat switch 22. In such an embodiment, the automatic thermostat switch 22 can be a self-contained unit that is positioned proximate the electric burner 50.

Referring again to FIGS. 2 and 4, it is contemplated that the automatic thermostat switch 22 can be positioned on a support member 140 positioned below the burner element 12 of the cooking appliance 14. In such an appliance 14, the automatic thermostat switch 22 can be disposed proximate a cooking bowl 142 that at least partially surrounds the burner element 12, where the cooking bowl 142 and the burner element 12 are both positioned below the cooking utensil 42. Accordingly, the position of the automatic thermostat switch 22 can be substantially fixed in relation to the burner element 12.

Referring again to FIGS. 1-10, according to various aspects of the device, the use of the automatic thermostat switch 22 can be used in conjunction with a user interface 150 for the cooking appliance 14. The user can engage the user interface 150 in order to input the food item 80 that is to be cooked within the cooking zone 20 (as exemplified by food items A, B and C in FIG. 10). Because various food items 80 can have different spontaneous ignition temperatures 82, the selection of the particular food item 80 sets the predetermined maximum temperature 28 and the control temperature 32 based upon the spontaneous ignition temperature 82 of the selected food item 80.

As illustrated in FIGS. 7 and 10, fluctuation of the actual temperature 26 between the predetermined maximum temperature 28 and the control temperature 32 is generally similar regardless of a food item 80 being prepared within the cooking zone 20. According to the various embodiments, it is also contemplated that the range of temperatures between the predetermined maximum temperature 28 and the control temperature 32 can be defined by various temperature fluctuation ranges 160. The temperature fluctuation range 160 between the predetermined maximum temperature 28 and the control temperature 32 can be a set temperature difference, for example, 20° F., 15° F., 10° F. or some other predetermined temperature below the predetermined maximum temperature 28. The temperature fluctuation range 160 can also be defined by a temperature percentage that is based upon the spontaneous ignition temperature 82 of the predetermined food item 80. By way of example, and not limitation, the predetermined maximum temperature 28 may be 10% below the spontaneous ignition temperature 82 of the particular food item 80 being prepared. The control temperature 32 may, in turn, be 20% below the spontaneous ignition temperature 82 of a particular food item 80. It is also contemplated that the control temperature 32 can be defined by a selected temperature for cooking the particular food item 80. By way of example, and not limitation, when the user operates the cooking appliance 14, the user may select a desired cooking temperature. It is contemplated that this temperature can be the control temperature 32 for the automatic temperature controlling device 10.

Referring now to FIGS. 1-10, having described various aspects of the automatic temperature controlling device 10, a method 400 is disclosed for controlling a heat source 16 for a burner element 12 of a cooktop. According to such a method 400, during operation of the automatic temperature controlling device 10, the user can set a desired burner temperature for cooking a particular food item 80 that is to be cooked in the cooking zone 20 (step 402). During operation of the cooking appliance 14, various measurements of the actual temperature 26 of the cooking zone 20 and/or the food item 80 can be performed (step 404) by the temperature sensing component 56 of the automatic thermostat switch 22. With each temperature measurement, the actual temperature 26 can be compared with a predetermined maximum temperature 28, that can correspond to an open temperature calibration 170 of the automatic temperature controlling device 10 (step 406). This open temperature calibration 170 or predetermined maximum temperature 28 is typically less than the spontaneous ignition temperature 82 of a particular food item 80, which, according to various embodiments can be in the range of approximately 177° C. for an exemplary ignitable food item 80. It is contemplated that the spontaneous ignition temperatures 82 of various food items 80 can vary depending on the physical characteristics of the food item 80. As discussed above, various buffer temperatures 84 can be included for defining the open temperature calibration 170 or the predetermined maximum temperature 28 of the particular food item 80. After the actual temperature 26 is compared with the open temperature calibration 170, the automatic temperature controlling device 10 determines whether the actual temperature 26 of the food item 80 and/or the cooking zone 20 has reached the open temperature calibration 170 (step 408). If the open temperature calibration 170 or the predetermined maximum temperature 28 has not been reached, further actual temperature measurements are taken (step 404). If the open temperature calibration 170 or the predetermined maximum temperature 28 has been reached, the amount of power provided to the burner element 12 is decreased (step 410). This can be accomplished by the control unit 54 moving the automatic thermostat switch 22 to the open position 30. Accordingly, a fuel flow rate provided to the burner element 12 is decreased or completely stopped, depending on the configuration of the automatic temperature controlling device 10. This decrease in power corresponds to the automatic thermostat switch 22 being moved to the open position 30.

As the temperature of the cooking zone 20 decreases, additional subsequent actual temperature measurements are taken (step 412). Again, the actual temperature measurements are compared with a closed temperature calibration 172, which can correspond to the control temperature 32, for the automatic thermostat switch 22 (step 414). It is then determined whether the actual temperature 26 is less than or equal to the closed temperature calibration 172 or the control temperature 32 (step 416). If the closed temperature calibration 172 or the control temperature 32 has not been reached, additional measurements of actual temperature 26 are taken until such time as the closed temperature calibration 172 or the control temperature 32 is reached. Once the control temperature 32 is reached, the automatic thermostat switch 22 is moved to the closed position 24, and power is returned to the burner element 12, such that a fuel flow rate is returned to its original setting (step 418).

Referring again to FIGS. 1-10, it is contemplated that the fluctuation of the actual temperature 26 between a predetermined maximum temperature 28 and the control temperature 32 is indicative of the cooking appliance 14 being unattended for a period of time. Accordingly, as the actual temperature 26 fluctuates between a predetermined maximum temperature 28 and a control temperature 32, various alarms, buzzers, or other indicia 180 that can be communicated by the cooking appliance 14 or communicated to the user, can be activated to alert the user that the cooking appliance 14 is being unattended. It is also contemplated that the fluctuation of the actual temperature 26 between the predetermined maximum temperature 28 and the control temperature 32 can initiate a time-out setting 182 where the cooking appliance 14 automatically shuts off or decreases to a predetermined low temperature 184 (i.e., a simmer setting, warm setting, or other substantially lower temperature). This time-out setting 182 can be based upon a certain time period or can be based upon a number of fluctuations between a predetermined maximum temperature 28 and the control temperature 32. Once it is determined that the predetermined time-out has been reached (step 420), the burner element 12 can be deactivated or at least limited to the lower burner setting 186 (step 422) indicative of the predetermined low temperature 184. It is also contemplated that once the appliance 14 is deactivated, or set to a lower burner setting 186, the alert communicated by the appliance 14 or communicated to the user, or both, can continue to be activated to alert the user that a change has been made in the operational cooking appliance 14.

According to the various embodiments, the implementation of the automatic temperature controlling device 10 is designed to prevent the cooking zone 20 from reaching a predetermined ignition temperature 82 of one or more food items 80 being cooked therein. By setting the predetermined maximum temperature 28 below the spontaneous ignition temperature 82 of the particular food item 80 being prepared, it is contemplated that the spontaneous ignition temperature 82 is likely to not be reached and the occurrence of flare-ups, food ignition, and other incendiary events can be limited.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A burner element for a cooktop, the burner element comprising:

a heat source for providing heat to a cooking zone positioned above the heat source; and a temperature sensor having an automatic thermostat switch in communication with the cooking zone and the heat source, wherein the automatic thermostat switch senses an actual temperature of the cooking zone, and wherein when the actual temperature reaches a predetermined maximum temperature, the automatic thermostat switch moves to an open position defined by the automatic thermostat switch at least partially impeding the heat source, wherein the open position of the automatic thermostat switch is further defined by a decrease in the actual temperature of the cooking zone from approximately the predetermined maximum temperature to a control temperature, and wherein when the actual temperature of the cooking zone reaches the control temperature, the automatic thermostat switch defines a closed position, wherein the automatic thermostat switch is substantially free of impeding the heat source, wherein the automatic thermostat switch is positioned directly below the heat source and records the actual temperature as an indirect measurement of heat emanating from the cooking zone, and wherein the automatic thermostat switch is positioned on a support member that is distal from the heat source, wherein the automatic thermostat switch selectively operates to modify a setting of the heat source to provide a decreased heat in response to the actual temperature reaching the predetermined maximum temperature, and wherein a heating level of the heat source is decreased and an indicia of the cooktop is activated after the actual temperature reaches the predetermined maximum temperature, and wherein the heat source is deactivated after the actual temperature has reached the predetermined maximum temperature a predetermined number of times.

2. The burner element of claim 1, wherein the cooking zone is defined by an interior volume of a cooking utensil placed upon the heat source.

3. The burner element of claim 1, wherein the heat source is an electric burner and the automatic thermostat switch, when in the open position, decreases flow of electric current to the electric burner, wherein a control unit in communication with the electric burner and the automatic thermostat switch operates the automatic thermostat switch between the open and closed positions.

4. The burner element of claim 3, wherein the open position of the automatic thermostat switch stops the flow of electric current to the electric burner.

5. The burner element of claim 1, wherein the automatic thermostat switch is in communication with a thermocouple disposed proximate the cooking zone, wherein the thermocouple measures the actual temperature of the cooking zone.

6. The burner element of claim 1, wherein the predetermined maximum temperature is a buffer temperature that corresponds to a spontaneous ignition temperature of a respective food product cooked in the cooking zone, wherein the respective food product is a predetermined food item of a plurality of food items.

7. The burner element of claim 6, wherein the buffer temperature is less than the spontaneous ignition temperature of the respective food product.

8. The burner element of claim 3, wherein the automatic thermostat switch and the electric burner are electrically connected in a series circuit configuration.

9. The burner element of claim 1, further comprising:

an encircling member that at least partially surrounds the heat source, wherein the automatic thermostat switch is positioned on the support member and directly below the heat source and the encircling member, wherein the indirect measurement is taken from proximate the encircling member.

10. A cooking appliance comprising:

a heating element defining a cooking zone positioned above the heating element, the cooking zone defining an actual temperature, the heating element having an encircling member that is positioned distal from and below the heating element and at least partially surrounds the heating element;

a temperature sensor having an automatic thermostat switch in communication with the cooking zone, the temperature sensor having the automatic thermostat switch being positioned on a support member that is directly below the heating element and the encircling member, wherein the temperature sensor and the support member are entirely below the encircling member; and a control in communication with the automatic thermostat switch and the heating element, wherein the automatic thermostat switch senses the actual temperature of the cooking zone, and wherein when the actual temperature is below a predetermined maximum temperature, the control maintains the automatic thermostat switch in a closed position defined by the heating element being free of impediment by the automatic thermostat switch, and wherein when the actual temperature reaches the predetermined maximum temperature, the control operates the automatic thermostat switch in an open position defined by the automatic thermostat switch at least partially decreasing an amount of heat provided by the heating element to the cooking zone, and wherein a heating level of the heating element is decreased and an indicia of the heating element is activated after the actual temperature reaches the predetermined maximum temperature, and wherein the heating element is deactivated after the actual temperature has reached the predetermined maximum temperature a predetermined number of times.

11. The cooking appliance of claim 10, wherein the open position is maintained by the automatic thermostat switch until the actual temperature sensed by the automatic thermostat switch decreases to at least a control temperature of the cooking zone, wherein when the actual temperature of the cooking zone reaches the control temperature, the control operates the automatic thermostat switch to the closed position.

12. The cooking appliance of claim 10, wherein the control is incorporated within the temperature sensor having the automatic thermostat switch, wherein the heating element is an electrically resistive heating element that is connected in series with the temperature sensor, and wherein the temperature sensor senses the actual temperature and regulates a flow of electrical current to the electrically resistive heating element.

13. The cooking appliance of claim 10, wherein the automatic thermostat switch is in communication with a thermocouple disposed proximate the cooking zone, wherein the thermocouple measures the actual temperature of the cooking zone.

14. The cooking appliance of claim 10, wherein the heating element is an electrically resistive heating element.

15. The cooking appliance of claim 10, wherein the automatic thermostat switch is positioned below the heating element and records the actual temperature as an indirect measurement of heat emanating from a cooking utensil.

16. The cooking appliance of claim 10, wherein the automatic thermostat switch and the heating element are electrically connected in a series circuit configuration.

17. A burner element for a cooktop, the burner element comprising:

a heat source for providing heat to a cooking zone positioned above the heat source;

an automatic thermostat switch positioned below the heat source and in communication with the cooking zone and the heat source, wherein the automatic thermostat switch senses an actual temperature of the cooking zone, and wherein when the actual temperature reaches a predetermined maximum temperature, the automatic thermostat switch moves to an open position defined by the automatic thermostat switch at least partially impeding the heat source, wherein the open position of the automatic thermostat switch is further defined by a decrease in the actual temperature of the cooking zone from approximately the predetermined maximum temperature to a control temperature, and wherein when the actual temperature of the cooking zone reaches the control temperature, the automatic thermostat switch defines a closed position, wherein the automatic thermostat switch is substantially free of impeding the heat source, wherein a heating level of the heat source is decreased and an indicia of the cooktop is activated after the actual temperature reaches the predetermined maximum temperature, and wherein the heat source is deactivated after the actual temperature has reached the predetermined maximum temperature a predetermined number of times.

18. The burner element of claim 17, wherein a control is incorporated within a temperature sensor having the automatic thermostat switch, wherein the heat source is an electrically resistive heating element that is connected in series with the temperature sensor, and wherein the temperature sensor senses the actual temperature and regulates a flow of electrical current to the electrically resistive heating element.

19. The burner element of claim 17, wherein the automatic thermostat switch is in communication with a thermocouple disposed proximate the cooking zone, wherein the thermocouple measures the actual temperature of the cooking zone.

* * * * *